US009194210B2

(12) United States Patent
Williamson, Jr.

(10) Patent No.: US 9,194,210 B2
(45) Date of Patent: Nov. 24, 2015

(54) DOWNHOLE POWER DELIVERY TOOL POWERED BY HYDROSTATIC PRESSURE

(71) Applicant: Halliburton Energy Services, Inc., Houston, TX (US)

(72) Inventor: Jimmie Robert Williamson, Jr., Carrollton, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 14/368,047

(22) PCT Filed: Aug. 2, 2013

(86) PCT No.: PCT/US2013/053375

§ 371 (c)(1),
(2) Date: Jun. 23, 2014

(87) PCT Pub. No.: WO2015/016937

PCT Pub. Date: Feb. 5, 2015

(65) Prior Publication Data

US 2015/0247377 A1 Sep. 3, 2015

(51) Int. Cl.
*E21B 34/06* (2006.01)

(52) U.S. Cl.
CPC ..... *E21B 34/063* (2013.01)

(58) Field of Classification Search
CPC ..... E21B 34/063; E21B 43/11852
See application file for complete search history.

(56) References Cited

U.S. PATENT DOCUMENTS

| | | | | |
|---|---|---|---|---|
| 4,650,010 | A | 3/1987 | George et al. | |
| 5,170,844 | A | 12/1992 | George et al. | |
| 6,145,598 | A | 11/2000 | Carisella | |
| 6,213,217 | B1 | 4/2001 | Wilson et al. | |
| 6,779,600 | B2 | 8/2004 | King et al. | |
| 2008/0110615 | A1 * | 5/2008 | Xu | 166/153 |
| 2008/0128130 | A1 * | 6/2008 | Whitsitt et al. | 166/278 |

OTHER PUBLICATIONS

International Patent ApplicationNo. PCT/US2013/053375 , "International Search Report and Written Opinion", mailed Apr. 28, 2014, 10 pages.

(Continued)

*Primary Examiner* — David Andrews
(74) *Attorney, Agent, or Firm* — Kilpatrick Townsend & Stockton LLP

(57) ABSTRACT

Certain aspects are directed to downhole power delivery tools using hydrostatic pressure within the wellbore. In one aspect, a downhole power delivery tool is provided that can be disposed in a wellbore through a fluid-producing formation. The downhole power delivery tool includes a body defining an inlet proximate to a chamber in the body, an actuation mechanism in the body and adjacent to the inlet, and a piston proximate to the chamber. The actuation mechanism can allow communication of hydrostatic pressure via the inlet to the chamber from an annulus external to the body in response to an actuation force being applied to the actuation mechanism. The hydrostatic pressure communicated to the chamber applies a first force to the piston. The piston applies a second force to a rod movable relative to the body in response to the first force being applied to the piston.

17 Claims, 10 Drawing Sheets

(56) References Cited

OTHER PUBLICATIONS

"Downhole Power Unit (DPU®)—Intelligent Series Tool", retrieved from the internet at http://www.halliburton.com/public/Ip/contents/Data_Sheets/web/H/H06387.pdf, at least as early as Dec. 11, 2012, Halliburton, 2 pages.

Slickline Downhole Power Unit Tool, Integrated Cased Hole Though-Tubing Services, Wireline & Perforating, http://www.halliburton.com/public/Ip/contents/Data_Sheets/web/H/H09463.pdf, 2012, 2 pages.

* cited by examiner

EXAMPLE FORCE PRODUCTION

| TOOL BODY OUTER DIAMETER (INCHES) | PISTONHEAD DIAMETER (INCHES) | ROD DIAMETER (INCHES) | DIFFERENTIAL AREA (SQ IN) | HYDROSTATIC PRESSURE (PSI) | FORCE (LBF) |
|---|---|---|---|---|---|
| 3.8 | 2.998 | 1.25 | 5.832 | 12,000 | 69,984 |
| 3.8 | 2.998 | 1.25 | 5.832 | 11,000 | 64,152 |
| 3.8 | 2.998 | 1.25 | 5.832 | 10,000 | 58,320 |
| 3.8 | 2.998 | 1.25 | 5.832 | 9,000 | 52,488 |
| 3.8 | 2.998 | 1.25 | 5.832 | 8,000 | 46,656 |
| 3.8 | 2.998 | 1.25 | 5.832 | 7,000 | 40,824 |
| 3.8 | 2.998 | 1.25 | 5.832 | 6,000 | 34,992 |
| 3.8 | 2.998 | 1.25 | 5.832 | 5,000 | 29,160 |
| 5.47 | 4.498 | 1.25 | 14.663 | 13,000 | 190,619 |
| 5.47 | 4.498 | 1.25 | 14.663 | 12,000 | 175,956 |
| 5.47 | 4.498 | 1.25 | 14.663 | 11,000 | 161,293 |
| 5.47 | 4.498 | 1.25 | 14.663 | 10,000 | 146,630 |
| 5.47 | 4.498 | 1.25 | 14.663 | 9,000 | 131,967 |
| 5.47 | 4.498 | 1.25 | 14.663 | 8,000 | 117,304 |
| 5.47 | 4.498 | 1.25 | 14.663 | 7,000 | 102,641 |
| 5.47 | 4.498 | 1.25 | 14.663 | 6,000 | 87,978 |
| 5.47 | 4.498 | 1.25 | 14.663 | 4,000 | 58,652 |
| 5.47 | 4.498 | 1.25 | 14.663 | 3,000 | 43,989 |
| 5.47 | 4.498 | 1.25 | 14.663 | 2,000 | 29,326 |

FIG. 11

DOWNHOLE POWER DELIVERY TOOL POWERED BY HYDROSTATIC PRESSURE

CROSS-REFERENCE TO RELATED APPLICATIONS

This is a U.S. national phase under 35 U.S.C. 371 of International Patent Application No. PCT/US2013/053375, titled "Downhole Power Delivery Tool Powered by Hydrostatic Pressure," filed Aug. 2, 2013, the entirety of which is incorporated herein by reference.

TECHNICAL FIELD

The present disclosure relates generally to devices for use in a wellbore in a subterranean formation and, more particularly (although not necessarily exclusively), to downhole power delivery tools using hydrostatic pressure within the wellbore.

BACKGROUND

Various devices can be utilized in a well traversing a hydrocarbon-bearing subterranean formation. Many such devices are configured to be actuated, installed, or removed by a force applied to the device while disposed in the well. In one example, a packer device may be installed in production tubing in the well by applying a force to an elastomeric element of the packer. The elastomeric element may expand in response to the force. Expansion of the elastomeric element may restrict the flow of fluid through an annulus between the packer and the tubing. In another example, a force may be applied to a removable plug device to withdraw the plug from an installed position in the wellbore.

As the depth of a well increases, corresponding increased temperatures may hinder the operation of various devices due to temperature limitations of components of the devices. At some depths, a device may experience greater pressure exerted upon the device by fluids in the wellbore. Actuating such a device may require applying sufficient amounts of force to overcome the force exerted by wellbore fluids to actuate, install, or remove the device.

BRIEF DESCRIPTION OF THE DRAWINGS

FIG. 11 is a table describing exemplary levels of force produced by the exemplary downhole power delivery tool according to one aspect of the present disclosure.

DETAILED DESCRIPTION

Figure 1:
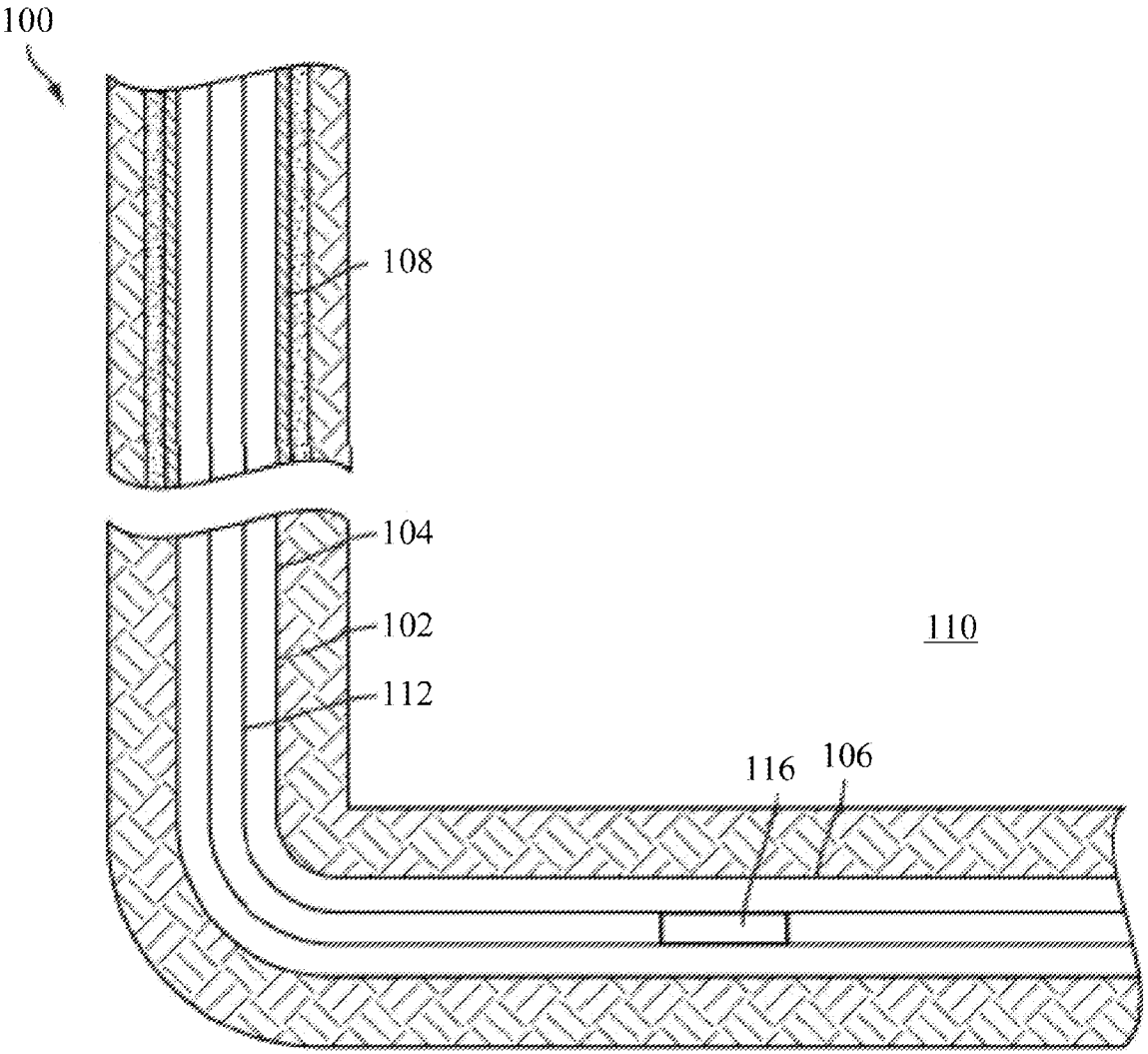
FIG. 1 is a schematic illustration of a well system having a downhole power delivery tool using hydrostatic pressure according to one aspect of the present disclosure.

Certain aspects and examples of the disclosure herein are directed to downhole power delivery tools using hydrostatic pressure within the wellbore. The downhole power delivery tool can utilize hydrostatic pressure in the wellbore to apply force to a piston or otherwise actuate tools in the wellbore. For example, a downhole power delivery tool using hydrostatic pressure can include a port adjacent to a movable barrier, such as a rupture disk. Hydrostatic pressure can be used to rupture the rupture disk or otherwise remove the barrier from the port. Removing the barrier from the port can allow fluid at a hydrostatic pressure to be communicated via the port from the wellbore to a piston disposed inside of the downhole power delivery tool. The fluid at the hydrostatic pressure can apply force to the piston. The piston can move in response to the application of the force from the hydrostatic pressure. Movement of the piston can cause an additional force to be applied to other components coupled to the piston, such as a rod used to actuate other downhole tools.

In some aspects, the downhole power delivery tool powered by hydrostatic pressure can include a body that can be disposed in the fluid-producing formation. The tool can also include at least a chamber, an inlet, an actuation mechanism, and a piston. The chamber can be disposed within the body. The inlet can provide a path for communication of fluid into the chamber from an annulus between the fluid-producing formation and the body. The actuation mechanism can block fluid communication through the inlet. The fluid communicated from the annulus can have a hydrostatic pressure associated with the depth at which the downhole power delivery tool is disposed within the fluid-producing formation. Applying an actuation force to the actuation mechanism can cause the actuation mechanism to unblock the inlet. Unblocking the inlet can allow fluid to flow through the inlet. The fluid flow through the inlet can communicate the hydrostatic pressure from the annulus to the chamber. The piston can be disposed adjacent to the chamber such that the hydrostatic pressure communicated to the chamber causes a first force to be applied to the piston. In response to the first force being applied to the piston, the piston can apply a second force to a rod that moves the rod relative to the body. Harnessing the hydrostatic pressure to power the movement of the rod allows the rod to provide levels of force that correspond to the high pressures exerted upon devices during operation in deep, high pressure, high temperature wells.

The actuation mechanism can be implemented using any suitable mechanism. In some aspects, the actuation mechanism can be a rupture disk. The rupture disk can have a burst pressure corresponding to an actuation force of the downhole power delivery tool. The burst pressure can be a pressure applied to the rupture disk that is sufficient to cause the rupture disk to rupture. The rupture disk can rupture in response to the actuation force being applied to the rupture disk. Rupturing the rupture disk can unblock the inlet. Unblocking the inlet can allow fluid to flow through the inlet into the chamber.

In additional or alternative aspects, the actuation mechanism can be a piston or other barrier positioned to block or obstruct the fluid path through the inlet. A suitable actuation force can be applied to the piston or other barrier. Applying the actuation force to the piston or other barrier can move the piston or barrier such that fluid can flow through the inlet.

In additional or alternative aspects, the actuation mechanism can be a piston or other member having a structure that defines a flow path into the chamber. The piston or other member can be positioned such that the defined flow path is not aligned with the inlet, thereby preventing fluid communication from the inlet to the chamber. A suitable actuation force can be applied to the actuation mechanism. Applying the actuation force to the actuation mechanism can move the piston or other member such that the flow path and the inlet are aligned. Aligning the flow path and the inlet can allow fluid communication through the inlet and the flow path into the chamber.

The actuation force for the actuation mechanism can be provided by any suitable mechanism and/or process. In some aspects, the actuation force can be generated by the hydrostatic pressure. The actuation mechanism can be triggered automatically upon reaching a target depth at which the hydrostatic pressure is sufficient to provide the actuation force. In a non-limiting example, the actuation mechanism may include a rupture disk. The rupture disk can rupture in response to a pressure corresponding to the hydrostatic pressure at a target depth. In another non-limiting example, the actuation mechanism may be a piston having dimensions and/or friction surfaces such that the hydrostatic pressure at the target depth is sufficient to cause the piston to move out of the way or into alignment at a target depth.

In other aspects, the actuation force can be generated by impact from a solid object. For example, the actuation mechanism may include a jarring apparatus. In one non-limiting example, the jarring apparatus can contact a member with sufficient force to allow fluid flow into the chamber by either repositioning the member to remove an inlet barrier or realigning the member to provide a flow path. In another non-limiting example, the jarring apparatus can contact a rupture disk with sufficient force to cause rupture.

In other aspects, the actuation mechanism can include a chemical charge configured to provide the actuation force. For example, detonation of a chemical charge may directly rupture a rupture disk or cause a projectile to rupture the rupture disk. In another non-limiting example, detonation of a chemical charge may reposition a piston or other member to remove an inlet barrier or realign the piston or other member to provide a flow path. The chemical charge may be detonated by any suitable mechanism such as, but not limited to, a timer providing an electrical signal to the chemical charge or a remote signal source communicating an electric signal to the chemical charge.

In additional or alternative aspects, the tool can include a hydraulic fluid used to apply the force to the rod of the downhole power delivery tool. In some aspects, the tool can further include a metering mechanism positioned adjacent to the hydraulic fluid and proximate to the rod. The metering mechanism can restrict a flow of the hydraulic fluid such that the rate of the hydraulic fluid flow to the rod is regulated. The rod can be moved at a controlled rate according to the rate of flow of the hydraulic fluid through the metering mechanism. In some aspects, use of a hydraulic fluid with known properties can be used for metering or other functions for deployment environments in which the composition of wellbore fluids may be difficult to determine or may be unsuitable for functions such as metering.

In additional or alternative aspects, the tool can include a hydraulic timer assembly for providing a delay between the tool receiving the actuation force and the movement of the rod. The hydraulic timer assembly can include a timer piston that can move from a first position to a second position in response to a force. The hydraulic timer assembly can also include a hydraulic fluid that opposes the movement of the piston from the first position to the second position. The hydraulic fluid can be displaced in response to the movement of the timer piston from the first position to the second position. The hydraulic timer assembly can further include a metering mechanism. The metering mechanism can restrict a flow of the hydraulic fluid such that the rate of the hydraulic fluid flow is regulated as the hydraulic fluid is displaced in response to the movement of the timer piston. The regulation of the hydraulic fluid flow can regulate the rate at which the hydraulic fluid is displaced and the rate at which the timer piston moves from the first position to the second position. The hydraulic timer assembly can provide a length of delay corresponding to a duration of the movement of the timer piston between the first and second positions.

These illustrative examples are given to introduce the reader to the general subject matter discussed here and are not intended to limit the scope of the disclosed concepts. The following sections describe various additional aspects and examples with reference to the drawings in which like numerals indicate like elements, and directional descriptions are used to describe the illustrative aspects. The following sections use directional descriptions such as "above," "below," "upper," "lower," "upward," "downward," "left," "right," "uphole," "downhole," etc. in relation to the illustrative aspects as they are depicted in the figures, the upward direction being toward the top of the corresponding figure and the downward direction being toward the bottom of the corresponding figure, the uphole direction being toward the surface of the well and the downhole direction being toward the toe of the well. Like the illustrative aspects, the numerals and directional descriptions included in the following sections should not be used to limit the present disclosure.

FIG. 1 schematically depicts a well system 100 having a tubing string 112 with at least one downhole power delivery tool 116 using hydrostatic pressure. The well system 100 includes a bore that is a wellbore 102 extending through various earth strata. The wellbore 102 has a substantially vertical section 104 and a substantially horizontal section 106. The substantially vertical section 104 and the substantially horizontal section 106 may include a casing string 108 cemented at an upper portion of the substantially vertical section 104. The substantially horizontal section 106 extends through a hydrocarbon bearing subterranean formation 110.

The tubing string 112 within wellbore 102 extends from the surface to the subterranean formation 110. The tubing string 112 can provide a conduit for formation fluids, such as production fluids produced from the subterranean formation 110, to travel from the substantially horizontal section 106 to the surface. Pressure from a bore in a subterranean formation can cause formation fluids, including production fluids such as gas or petroleum, to flow to the surface.

The well system 100 can also include at least one downhole power delivery tool 116. The downhole power delivery tool 116 can be deployed in the tubing string 112. The downhole power delivery tool 116 can apply force to one or more downhole components, as described in detail with respect to FIGS. 2-17B below.

Although FIG. 1 depicts the downhole power delivery tool 116 in the substantially horizontal section 106, the downhole power delivery tool 116 can be located, additionally or alternatively, in the substantially vertical section 104. In some aspects, the downhole power delivery tool 116 can be disposed in simpler wellbores, such as wellbores having only a substantially vertical section. A downhole power delivery tool 116 can be disposed in openhole environments, such as is depicted in FIG. 1, or in cased wells. Although FIG. 1 depicts a single downhole power delivery tool 116 deployed in the tubing string 112, any number of downhole power delivery tool can be deployed in the tubing string 112.

Figure 2:
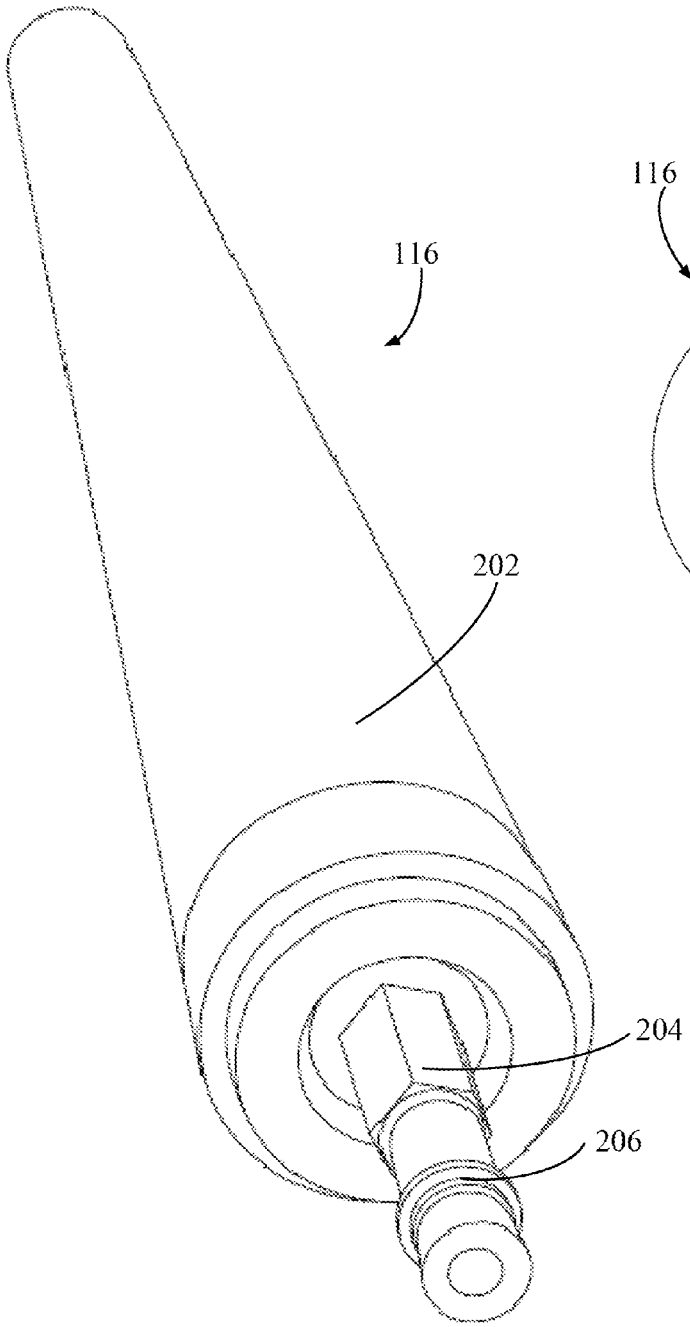
FIG. 2 is a perspective view of a downhole power delivery tool using hydrostatic pressure according to one aspect of the present disclosure.
Figure 3:
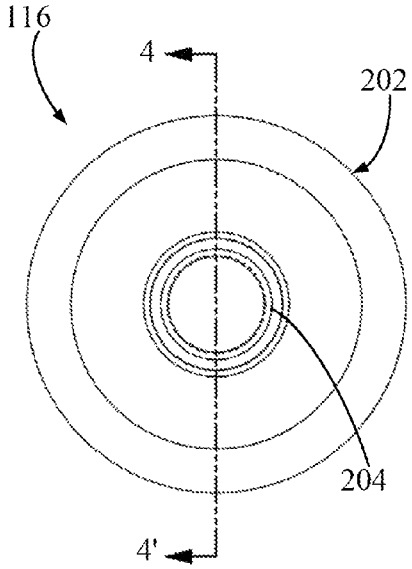
FIG. 3 is a lateral view of a downhole power delivery tool using hydrostatic pressure according to one aspect of the present disclosure.

FIG. 2 is a perspective view of an exemplary downhole power delivery tool 116 according to one aspect. FIG. 3 is a lateral view of the downhole power delivery tool 116. The downhole power delivery tool 116 can include a body 202 and a rod 204.

The body 202 can have a size sufficient for the downhole power delivery tool 116 to be inserted and removed from the tubing string 112. The body 202 can define an inner volume in which additional components of the downhole power delivery tool 116 can be disposed. A wall of the body 202 can have a thickness sufficient to withstand heat and/or pressure of a target depth in the well system 100 at which the downhole power delivery tool 116 is to be deployed. The body 202 can be manufactured from any suitable material, such as steel or other metals.

The rod 204 can be extended from and/or retracted into the body 202. Extending or retracting the rod 204 can apply a force to another tool within the tubing string 112. The rod 204 can include any suitable coupling mechanism 206 for attaching or otherwise coupling the downhole power delivery tool 116 with another tool within the tubing string 112. In one non-limiting example, the coupling mechanism 206 may be a threaded surface that can interface with a mating threaded surface on another tool within the tubing string 112. In another non-limiting example, the coupling mechanism 206 may include a flange that can fit within a groove in a second tool within the tubing string 112. The flange of the coupling mechanism 206 and the groove in a second tool can maintain the rod 204 and the second tool in a locked position.

Figure 4:
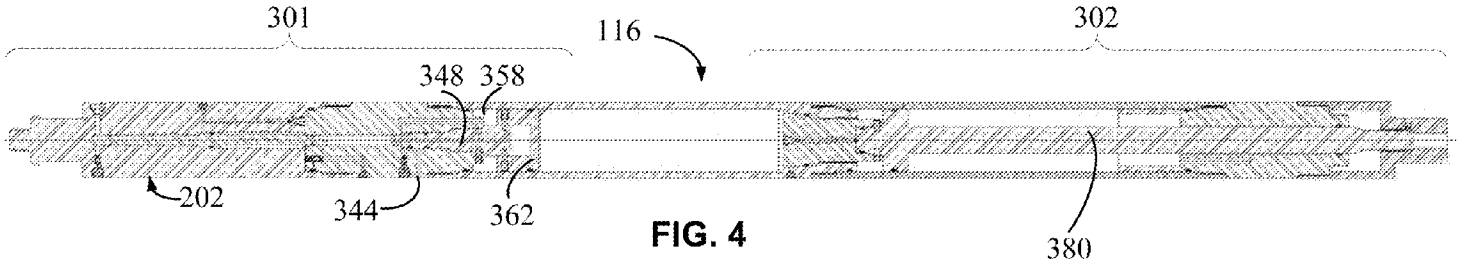
FIG. 4 is a longitudinal cross-sectional view of an exemplary downhole power delivery tool using hydrostatic pressure according to one aspect of the present disclosure.

FIG. 4 is a longitudinal cross-sectional view depicting an exemplary downhole power delivery tool 116. The cross-sectional view is taken along the line 4-4' depicted in FIG. 3. As depicted in FIG. 4, the downhole power delivery tool 116 can include a body 202, an actuation inlet 344, a barrier piston 348, a chamber 358, a piston 362, and a rod 380.

The actuation inlet 344 can be disposed through the body 202. The actuation inlet 344 can communicate fluid into the chamber 358 from an annulus between the body 202 and the formation 110. The annular fluid can have a hydrostatic pressure.

The chamber 358 and the barrier piston 348 can be disposed within the body 202. The barrier piston 348 can prevent communication of the annular fluid via the actuation inlet 344. Applying an actuation force to the barrier piston 348 can displace the barrier piston 348. Displacing the barrier piston 348 can allow communication of the annular fluid into the chamber 358 via the actuation inlet 344. In one non-limiting example, a hydrostatically actuated electronic timing circuit utilizing a short stroke pushing mechanism can be used to displace the barrier piston 348 and actuate the downhole power delivery tool 116. In another non-limiting example, an electronic power delivery tool can be used to move the barrier piston 348 to actuate the downhole power delivery tool 116.

The piston can be disposed within the body 202 and proximate to the chamber 358. Communication of the annular fluid into the chamber 358 can cause annular fluid in the chamber 358 to apply a first force to the piston 362. Applying a first force to the piston 362 can cause the piston 362 to apply a second force to the rod 380. FIG. 4 depicts the rod 380 retracted into the body 202 of the downhole power delivery tool 116. Applying the second force to the rod 380 can extend the rod 380. Extending the rod 380 can apply a force to another tool within the tubing string 112.

Figure 5A:
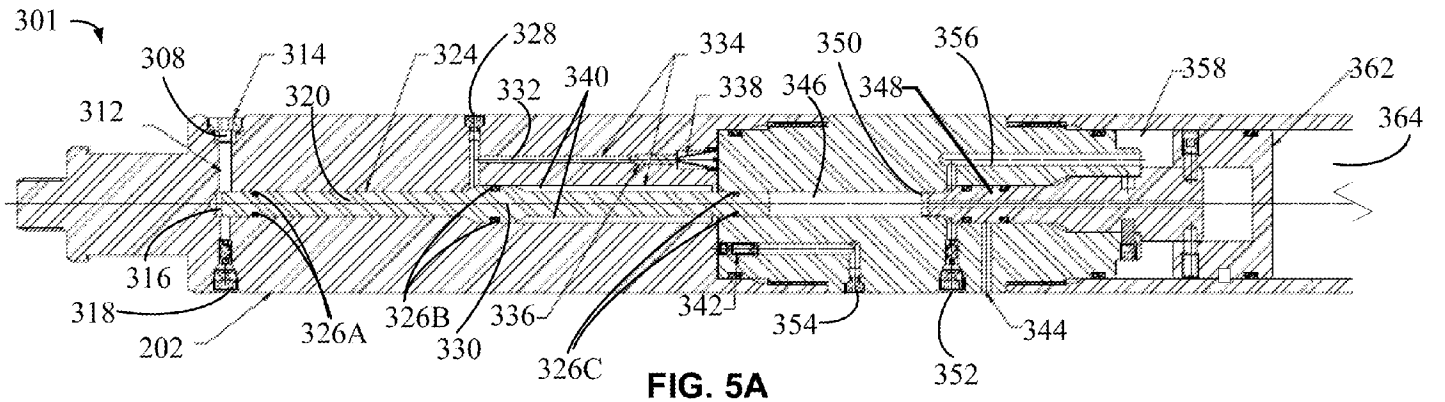
FIG. 5A is a longitudinal cross-sectional view of a first portion of the exemplary downhole power delivery tool using hydrostatic pressure according to one aspect of the present disclosure.

FIG. 5A is a longitudinal cross-sectional view depicting a first portion 301 of the exemplary downhole power delivery tool 116. As depicted in FIG. 5A, the body 202 of the downhole power delivery tool 116 can include a timer entry inlet 312 and a rupture disk 314. The timer entry inlet 312 can be configured as a vacuum pressure chamber. In some aspects, a vacuum pressure chambers can be an atmospheric pressure chambers filled with air. A vacuum pressure chamber can be evacuated through the vacuum test ports 318 using a vacuum pump. In some aspects, evacuating the chamber can provide a seal test.

The rupture disk 314 can be disposed proximate to or within the timer entry inlet 312. Positioning the rupture disk 314 proximate to or within the timer entry inlet 312 can seal the timer entry inlet 312. Sealing the timer entry inlet 312 can maintain a vacuum pressure within the timer entry inlet 312. Sealing the timer entry inlet 312 can also prevent fluid communication via the timer entry inlet 312 from the annulus between the body 202 and the formation 110 to an inner volume of the body 202.

The downhole power delivery tool can also include vacuum test ports 318, 328, 354. The vacuum test port 318 can be positioned adjacent to the timer entry inlet 312. The vacuum test port 318 can provide an interface by which a diagnostic tool can determine whether the timer entry inlet 312 is functioning correctly and is maintaining a vacuum. The vacuum test port 318 can verify the proper fit and function of the vacuum chamber seals. Vacuum test port 318 can be utilized to verify that the vacuum pressure of the timer entry inlet 312 has not been disturbed. The vacuum test port 328 can be used to verify that the passageway 322 is at a vacuum pressure. The vacuum test port 354 can be used to test the seal on a check valve 342.

The downhole power delivery tool can include a timer piston 320. The timer piston 320 can be disposed in a passageway 324. The passageway 324 can define a path through which the timer piston 320 can move. The barrier piston 348 can be positioned proximate to an end of passageway 324. The barrier piston 348 can seal the actuation inlet 344. Sealing the actuation inlet 344 can prevent fluid communication from the annulus between the body 202 and the formation 110 through the actuation inlet 344. Preventing fluid communication through the actuation inlet 344 can prevent fluid communication through a conduit 356 into the chamber 358 in the body 202. The chamber 358 can also be configured as a vacuum pressure chamber. A vacuum test port 352 can be provided in the body 202 to determine whether the chamber 358 is maintaining a vacuum pressure.

The downhole power delivery tool 116 can also include a quantity of hydraulic fluid 364. The hydraulic fluid can be used to communicate a force from the piston 362 to the rod 380. The piston 362 can be positioned in between the chamber 358 and the hydraulic fluid 364.

Figure 5B:
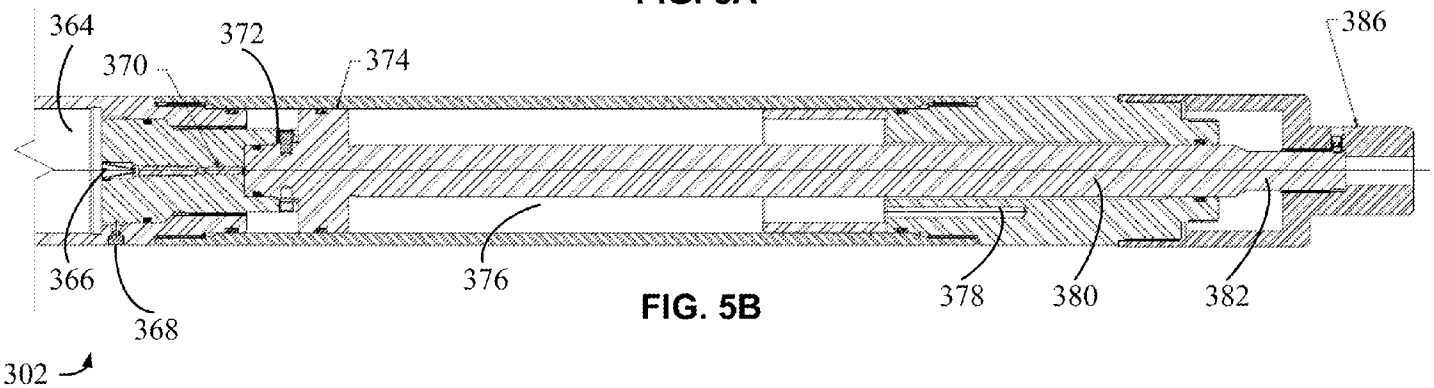
FIG. 5B is a longitudinal cross-sectional view of a second portion of the exemplary downhole power delivery tool using hydrostatic pressure according to one aspect of the present disclosure.

FIG. 5B is a longitudinal cross-sectional view depicting a second portion 302 of the exemplary downhole power delivery tool 116. As depicted in FIG. 5B, the downhole power delivery tool 116 can also include a filter 366, a fill plug 368, a metering mechanism 370, and a rod chamber 376.

The fill plug 368 may be removed to introduce the hydraulic fluid 364 into the downhole power delivery tool 116. The fill plug 368 may be reinserted to seal the hydraulic fluid 364 within the downhole power delivery tool 116.

The filter 366 and/or the metering mechanism 370 can be disposed at position such that the filter 366 and/or the metering mechanism 370 are in fluid communication with the hydraulic fluid 364. A piston head 374 can be positioned adjacent to the hydraulic fluid 364 so as to prevent fluid communication of the hydraulic fluid 364 into the rod chamber 376. The piston head 374 can be connected to the rod 380. The rod 380 can be positioned in the rod chamber 376. The rod 380 can extend from the body 202. In some aspects, the rod 380 can include an adaptor end 382. The adaptor end 382 can provide an interface for coupling the downhole power delivery tool 116 with other downhole tools.

The downhole power delivery tool 116 can also include a protective sheath 386. In some aspects, the protective sheath 386 may be coupled to the body of the downhole power delivery tool 116. In other aspects, the sheath may be coupled to the rod 380. The protective sheath 386 can be coupled to a suitable part of the downhole power delivery tool 116 via any suitable mechanism. A non-limiting example of a suitable mechanism for coupling the protective sheath 386 to the downhole power delivery tool 116 is a fastener 384. Coupling the protective sheath 386 to the downhole power delivery tool 116 can protect the adaptor end 382 during transport or storage of the downhole power delivery tool 116. The protective sheath 386 can be removed to prepare the downhole power delivery tool 116 for deployment and actuation.

Actuation of the downhole power delivery tool 116 can be initiated by rupturing the rupture disk 314. The rupture disk 314 can rupture in response to a pressure differential across the rupture disk 314 exceeding the pressure rating of the rupture disk 314. In some aspects, the rupture disk 314 can rupture at a target hydrostatic pressure corresponding to a target depth. The timer entry inlet 312 can be set to a vacuum pressure. Setting the timer entry inlet 312 to the vacuum pressure can cause the pressure differential across the rupture disk to be approximately equal to the hydrostatic pressure of the fluid from the annulus between the body 202 and the formation 110. In other aspects, an explosive charge 308 can be positioned adjacent to the rupture disk 314. Detonating the charge 308 can cause the rupture disk 314 to rupture. In one non-limiting example, the detonation of the charge 308 can rupture the rupture disk 314. In another non-limiting example, the detonation of the charge 308 can propel an object toward the rupture disk 314 with sufficient force to rupture the rupture disk 314.

Rupturing the rupture disk 314 can allow liquid, gas, or some combination thereof from the annulus to flow into the timer entry inlet 312. An O-ring 326*a* can be disposed between the outer diameter of the timer piston 320 and the passageway 324. The O-ring 326*a* can prevent a flow of the fluid past the timer piston 320 through the passageway 324. Fluid at a hydrostatic pressure that enters the timer entry inlet 312 from outside the body 202 can communicate the hydrostatic pressure to an upper face 316 of the timer piston 320. Communicating the hydrostatic pressure to the upper face 316 of the timer piston 320 can produce a force on the upper face 316 of the timer piston 320. Producing a force on the upper face 316 of the timer piston 320 can cause the timer piston 320 to move through the passageway 324 toward the barrier piston 348.

Movement of the timer piston 320 can be resisted by a quantity of timer hydraulic fluid 334. The timer hydraulic fluid 334 can be disposed around a lower portion of the timer piston 320 in a timer fluid chamber 340. The lower portion of timer piston 320 can be adjacent to an upper portion 330 of the timer piston 320 having a greater diameter than the lower portion. The upper portion 330 of the timer piston 320 can include an O-ring 326*b* positioned between the circumference of the timer piston 320 and the passageway 324. The O-ring 326*b* can prevent the timer hydraulic fluid 334 from flowing past the upper portion 330 of the timer piston 320. The timer piston 320 can also include an O-ring 326*c* positioned on an end of the timer piston 320 distal to the upper portion 330 of the timer piston 320. The O-ring 326*c* can prevent timer hydraulic fluid 334 from flowing into a passageway 346 adjacent the timer fluid chamber 340. Preventing timer hydraulic fluid 334 from flowing past the upper portion 330 of the timer piston 320 or into the passageway 346 can prevent leakage of the timer hydraulic fluid 334. Preventing leakage of the timer hydraulic fluid 334 can maintain the timer hydraulic fluid 334 in the timer fluid chamber 340 such that a movement of the timer piston 320 in the passageway 324 toward the barrier piston 348 can exert a force on the timer hydraulic fluid 334.

The force exerted on the timer hydraulic fluid 334 by the timer piston 320 can be sufficient to displace the timer hydraulic fluid 334 from the timer fluid chamber 340. The timer hydraulic fluid 334 can be displaced from the timer fluid chamber 340 and communicated through a passageway 332 to a position adjacent to the upper portion 330 of timer piston 320. Communicating the timer hydraulic fluid 334 from a first position on a first side of the upper portion 330 of the timer piston 320 to a second position on a second side of the upper portion 330 of the timer piston 320 can cause the timer hydraulic fluid 334 to apply a balanced level of hydraulic pressure to both sides of the upper portion 330. Balancing the hydraulic pressure on the upper portion 330 of the timer piston 320 can allow the hydrostatic pressure applied to the upper face 316 of the timer piston 320 to move the timer piston 320 with less interference from the displacement of the timer hydraulic fluid 334.

Communicating the timer hydraulic fluid 334 through the passageway 332 can cause the timer hydraulic fluid 334 to pass through a filter 338. Communicating the timer hydraulic fluid 334 through the passageway 332 can also cause the timer hydraulic fluid 334 to pass through a timer metering mechanism 336.

The timer metering mechanism 336 can regulate the speed of the movement of the timer piston 320. The timer metering mechanism 336 can restrict a flow of the timer hydraulic fluid 334 passing through the metering mechanism. Restricting the flow of the timer hydraulic fluid 334 can reduce a rate of flow of the timer hydraulic fluid 334. The reduced flow rate can reduce a rate at which the timer hydraulic fluid 334 is displaced from the timer fluid chamber 340. Reducing the rate at which the timer hydraulic fluid 334 is displaced can cause the timer piston 320 to move at a reduced speed.

Figure 6:
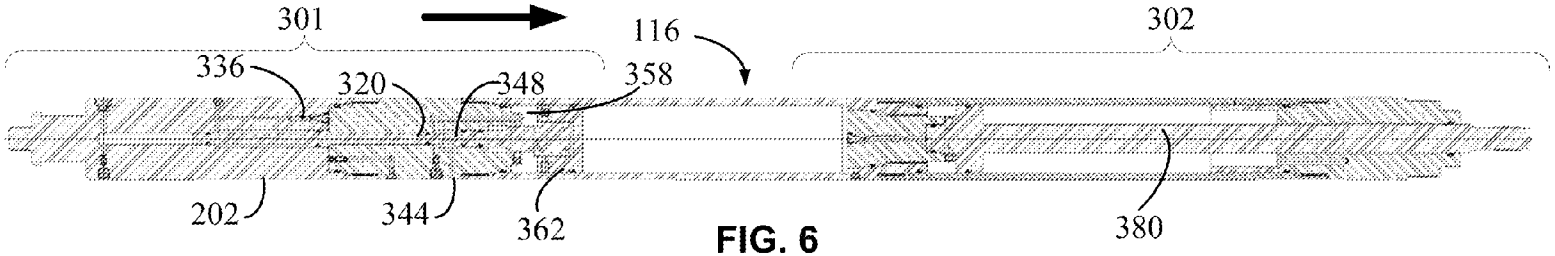
FIG. 6 is a longitudinal cross-sectional view of the exemplary downhole power delivery tool with a timer mechanism metered by a metering mechanism according to one aspect of the present disclosure.

FIG. 6 is a longitudinal cross-sectional view of the exemplary downhole power delivery tool 116 with a timer piston 320 metered by a timer metering mechanism 336. The timer metering mechanism 336 can cause the timer piston 320 to move at a metered rate into contact with the barrier piston 348, as depicted by the rightward arrow in FIG. 6. The movement of the timer piston 320 in contact with the barrier piston 348 can exert a force on the barrier piston 348. The force exerted on the barrier piston 348 can cause the barrier piston 348 to move.

Figure 7A:
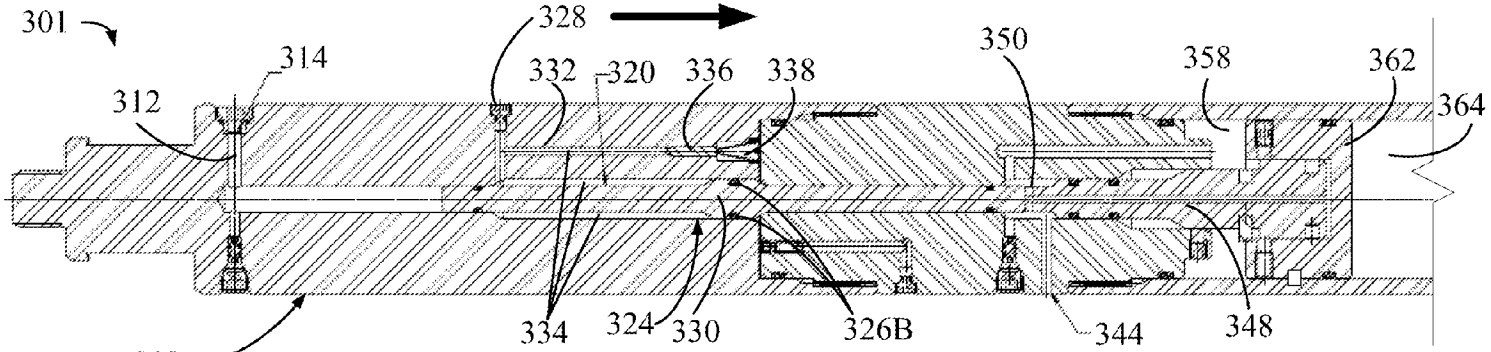
FIG. 7A is a longitudinal cross-sectional view of a first portion of the exemplary downhole power delivery tool with the timer mechanism metered by the metering mechanism according to one aspect of the present disclosure.

FIG. 7A is a longitudinal cross-sectional view of the first portion 301 of the exemplary downhole power delivery tool 116 with the timer piston 320 metered by the timer metering mechanism 336. As depicted in FIG. 7A, the timer piston 320 can move the barrier piston 348. Moving the barrier piston 348 can expose the actuation inlet 344. Exposing the actuation inlet 344 can allow fluid at a hydrostatic pressure from outside of the body 202 to be communicated through the actuation inlet 344 to the chamber 358. Communicating the fluid to the chamber 358 can increase the pressure in the chamber 358 from a vacuum pressure to the hydrostatic pressure.

Fluid may be communicated from the actuation inlet 344 to the chamber 358 by any suitable path. For example, FIG. 7A depicts a fluid flow path in which the fluid flows into the chamber 358. The fluid can flow through the actuation inlet 344 toward the barrier piston 348. The fluid can traverse the barrier piston 348 by flowing around a smaller diameter portion of the barrier piston 348 and/or by flowing through a conduit provided in an end 350 of the barrier piston 348. Fluid traversing the barrier piston 348 can flow through a conduit 356. Fluid can flow through the conduit 356 and into the chamber 358.

Figure 7B:
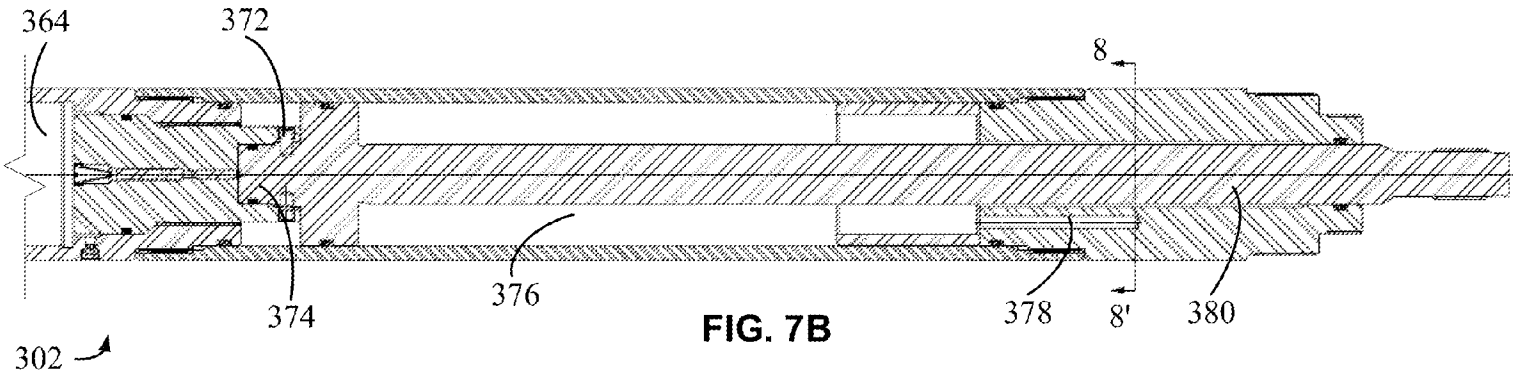
FIG. 7B is a longitudinal cross-sectional view of a second portion of the exemplary downhole power delivery tool with the timer mechanism metered by the metering mechanism according to one aspect of the present disclosure.

FIG. 7B is a longitudinal cross-sectional view of a second portion 302 of the exemplary downhole power delivery tool 116 with the timer mechanism metered by the metering mechanism. As discussed above with respect to FIG. 5B, the power downhole power delivery tool 116 can include hydraulic fluid 364, a metering mechanism 370, a piston head 374, a rod chamber 376, and a rod 380. The piston head 374 can be disposed adjacent to the hydraulic fluid 364. Positioning the piston head 374 adjacent to the hydraulic fluid 364 can prevent fluid communication of the hydraulic fluid 364 into the rod chamber 376. The position of the piston head 374 adjacent to the hydraulic fluid 364 can allow the pressure of the hydraulic fluid 364 to exert a force on the piston head 374. The force exerted on the piston head 374 by the hydraulic fluid 364 can cause the piston head 374 to move and extend the rod 380.

As depicted in FIG. 7B, the downhole power delivery tool 116 can also include shear pins 372. The shear pins 372 may be fabricated with a suitable size and material so as to be capable of withstanding forces up to a specific force threshold. The shear pins 372 can prevent inadvertent movement of the piston head 374 by restraining the piston head 374 in place in the absence of the specific level of force. Applying a force having a sufficient magnitude to the shear pins 372 can break the shear pins 372. Breaking the shear pins 372 can remove a restraint on the piston head 374. As depicted in FIG. 7B, the shear pins 372 can resist the force that the timer hydraulic fluid 334 exerts on the piston head 374. Resisting the force exerted by the timer hydraulic fluid 334 can maintain the position of the rod 380. Increasing the pressure of the timer hydraulic fluid 334 to a sufficient magnitude can cause the timer hydraulic fluid 334 to exert a force on the piston head 374 that is sufficient to break the shear pins 372. Breakage of the shear pins 372 can allow the piston head 374 to move in response to the force exerted by the timer hydraulic fluid 334.

The rod chamber 376 can also be configured as a vacuum pressure chamber. Configuring the rod chamber 376 as a vacuum pressure chamber can reduce resistance to the movement of the piston head 374 during extension of the rod 380 from the body 202.

Figure 8:
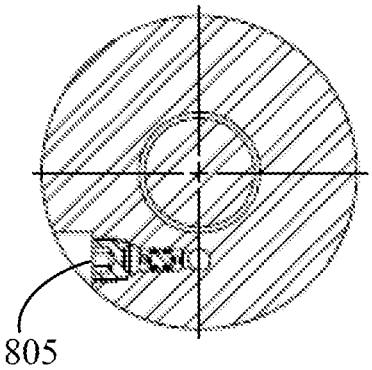
FIG. 8 is a lateral cross-sectional view of the exemplary downhole power delivery tool using hydrostatic pressure according to one aspect of the present disclosure.

FIG. 8 is a lateral cross-sectional view of the exemplary downhole power delivery tool 116 using hydrostatic pressure. FIG. 8 is taken along the line 8-8' depicted in FIG. 7B of the exemplary downhole power delivery tool 116. As depicted in FIG. 8, a power delivery downhole power delivery tool 116 can include a vacuum test port 805. The vacuum test port 805 can be in fluid communication with the rod chamber 376 via a test channel 378 depicted in FIG. 7B. The vacuum test port 805 can be utilized to test the rod chamber 376 for deployment. Testing the rod chamber 376 can include verifying that the rod chamber 376 is maintaining a vacuum pressure.

Figure 9:
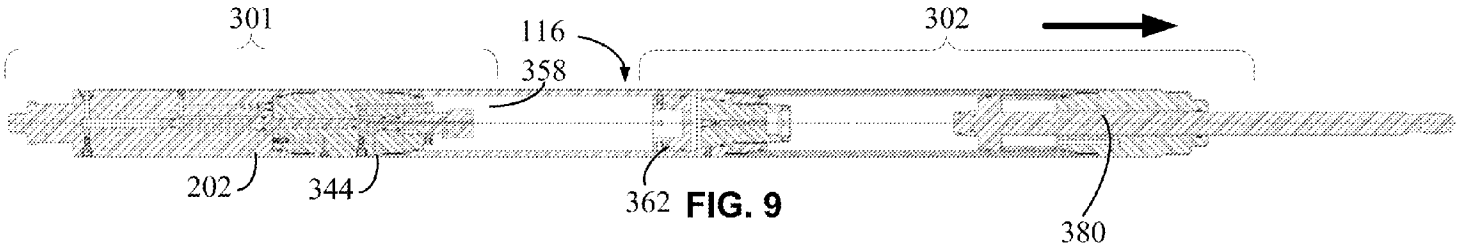
FIG. 9 is a longitudinal cross-sectional view of the exemplary downhole power delivery tool actuated by hydrostatic pressure according to one aspect of the present disclosure.

FIG. 9 is a longitudinal cross-sectional view of the exemplary downhole power delivery tool 116 actuated by hydrostatic pressure. As depicted by the rightward arrow in FIG. 9, communication of fluid having a hydrostatic pressure via the actuation inlet 344 can cause the chamber 358 to fill with the annular fluid. Filling the chamber 358 can cause the piston 362 to move. Movement of the piston 362 can cause rod 380 to extend.

Figure 10A:
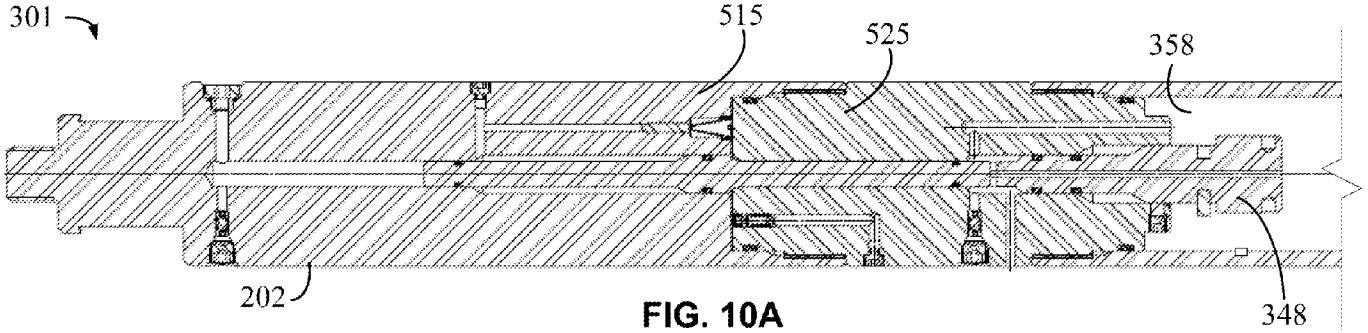
FIG. 10A is a longitudinal cross-sectional view of a first portion of the exemplary downhole power delivery tool actuated by hydrostatic pressure according to one aspect of the present disclosure.

FIG. 10A is a longitudinal cross-sectional view of a first portion of the exemplary downhole power delivery tool 116 actuated by hydrostatic pressure. As depicted in FIG. 10A, the chamber 358 can be filled with fluid from outside the body 202. Filling the chamber 358 with the fluid can cause the chamber to approach the hydrostatic pressure of the fluid. Pressurizing the chamber 358 to approach hydrostatic pressure can cause the chamber 358 to exert a sufficient force on the piston 362 to cause the piston 362 to move away from a position proximate to the barrier piston 348.

Figure 10B:
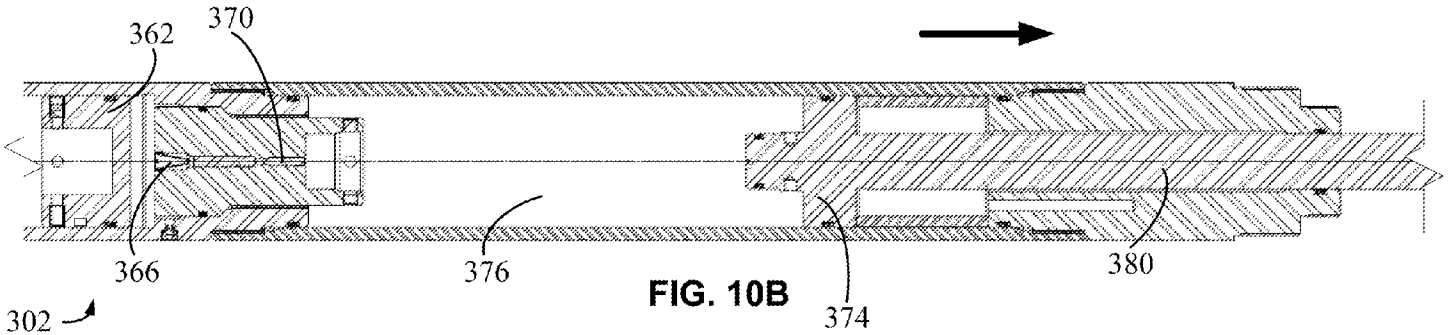
FIG. 10B is a longitudinal cross-sectional view of a second portion of the exemplary downhole power delivery tool actuated by hydrostatic pressure according to one aspect of the present disclosure.

FIG. 10B is a longitudinal cross-sectional view of a second portion of the exemplary downhole power delivery tool 116 actuated by hydrostatic pressure. As depicted by the rightward arrow in FIG. 10B, the force exerted on the piston 362 by the chamber 358 at hydrostatic pressure can cause the piston to move toward a position proximate to the filter 366 and the metering mechanism 370. The piston 362 can communicate the hydrostatic pressure from the chamber 358 to the hydraulic fluid 364 disposed on the opposite side of the piston 362. Communicating the hydrostatic pressure to the hydraulic fluid 364 can cause the hydraulic fluid 364 to be pressurized to approximately the same pressure as the hydrostatic pressure of the fluid in the chamber 358. The movement of the piston 362 can cause the hydraulic fluid 364 to flow into the rod chamber 376. The flow of the hydraulic fluid 364 having a pressure at or near the hydrostatic pressure into the rod chamber 376 can exert a force on the piston head 374 of the rod 380. The force exerted on the piston head 374 of the rod can cause the rod 380 to extend from the downhole power delivery tool 116. The extension of the rod 380 can actuate another downhole tool in the tubing string 112.

As depicted in FIG. 10B, the metering mechanism 370 and/or the filter 366 can be disposed between the piston 362 and the piston head 374 such that the hydraulic fluid 364 may also flow through the filter 366 and/or the metering mechanism 370. The metering mechanism 370 can cause the timer hydraulic fluid 334 to enter the rod chamber 376 at controlled rate. Controlling the rate at which the timer hydraulic fluid 334 enters the rod chamber 376 can control the rate at which the rod extends to deliver power to another tool.

FIG. 11 is a table showing exemplary levels of force produced by the downhole power delivery tool 116. The amount of power that can be delivered by a downhole power delivery tool 116 can vary according to various features, including the hydrostatic pressure at a depth in the wellbore 102 and the dimensions of different components of the downhole power delivery tool 116. As non-limiting examples, FIG. 11 depicts possible power delivery in pounds-force ("LBF") of different sizes of the downhole power delivery tool 116 based on the hydrostatic pressure available.

Possible power delivery can be based on the forces exerted on the piston head 374 and the rod 380. The hydraulic fluid 364 can exert a force on the piston head 374 that is directly opposed by a force exerted on the rod 380 by the annular fluid. The hydraulic fluid 364 and the annular fluid can each have a pressure equivalent to the hydrostatic pressure such that the net force exerted by the downhole power delivery tool 116 is equivalent to the hydrostatic pressure multiplied by the differential area between cross-sectional area of the piston head 374 and the cross-sectional area of the rod 380.

For example, the first row of the table depicted in FIG. 11 refers to an exemplary downhole power delivery tool 116 having a body with a nominal outer diameter of 3.8 inches. The diameter of the piston head 374 can be 2.998 inches such that a cross-sectional area of the piston head 374 is 7.059 square inches. The diameter of the rod 380 can be 1.25 inches such that a cross-sectional area of the rod 380 is 1.227 square inches. A hydrostatic pressure of 12,000 pounds per square inch applied to the differential cross-sectional area of 5.832 square inches can provide an power delivery force of 69,984 LBF.

Figure 12:
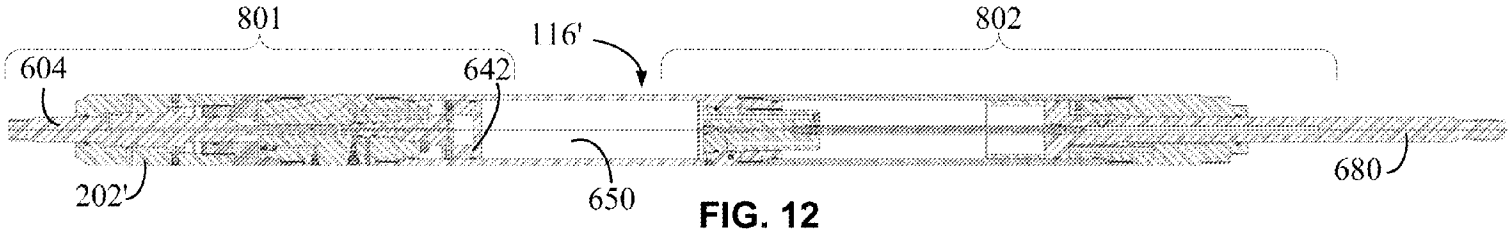
FIG. 12 is a longitudinal cross-sectional view of an alternative exemplary downhole power delivery tool using hydrostatic pressure according to one aspect of the present disclosure.

In additional or alternative aspects, a downhole power tool may be actuated via impact from a solid object. FIG. 12 is a longitudinal cross-sectional view of an alternative exemplary downhole power delivery tool 116' using hydrostatic pressure. The cross-sectional view is taken along the line 4-4' depicted in FIG. 3. As depicted in FIG. 12, the downhole power delivery tool 116' can include a body 202', a structure 604, a piston 642, a hydraulic fluid 650, and a rod 680. Actuation of the structure 604 can cause the piston 642 to move. Movement of the piston 642 can cause the hydraulic fluid 650 to be communicated toward the rod 680. Communication of the hydraulic fluid 650 toward the rod 680 can cause the rod 680 to retract into the body 202' of the downhole power delivery tool 116'. Retraction of the rod 680 can be utilized to deliver power to other tools disposed in the wellbore.

Figure 13A:
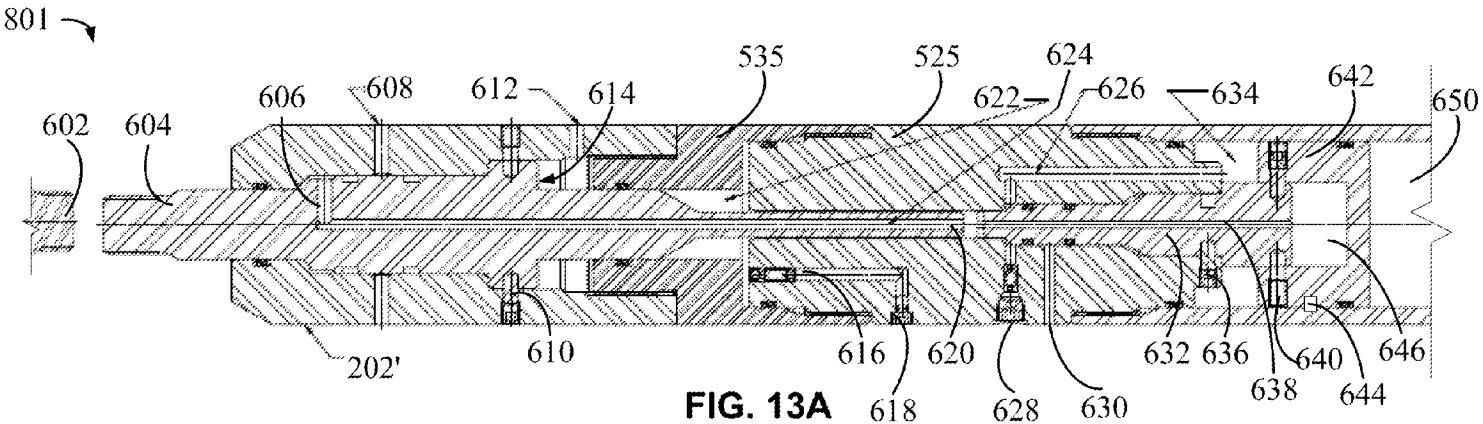
FIG. 13A is a longitudinal cross-sectional view of a first portion of the alternative exemplary downhole power delivery tool using hydrostatic pressure according to one aspect of the present disclosure.

FIG. 13A is a longitudinal cross-sectional view of a first portion 801 of the alternative exemplary downhole power delivery tool 116' using hydrostatic pressure. As depicted in FIG. 13A, the downhole power delivery tool 116' can include an inlet 608, a structure 604, a vacuum pressure chamber 622 and an actuation structure 632.

The inlet 608 can be positioned in the body 202' so as to provide fluid communication through the inlet 608 into the body 202' from the annulus between the body 202' and the formation 110.

In a first position, at least a portion of the structure 604 can protrude from the body 202'. An actuation force can be applied to the protruding portion of the structure 604. For example, a solid object 602 can contact the structure 604 to apply the actuation force.

The structure 604 can define a port 606 and a conduit 624. In the first position, the port 606 can be positioned such that the port 606 is not aligned with the inlet 608, thereby preventing fluid communication from outside of the body 202' through the inlet 608 to an inner diameter of the body 202'.

The vacuum pressure chamber 622 can be positioned proximate to the structure 604. The structure 604 can displace into the vacuum pressure chamber 622 in response to the actuation force being applied to the structure 604. In some aspects, the downhole power delivery tool 116' can also include a vacuum test port 618 to test a check valve 616 and a vacuum test port 628 to check a passage 626.

In some aspects, the downhole power delivery tool 116' can also include a balance inlet 612 through the body 202'. The balance inlet 612 can provide a flow path for communicating fluid from the wellbore 102 to a surface 614 of the structure 604. The fluid can exert a pressure equal to the hydrostatic pressure of the wellbore on the surface 614, thereby counteracting the hydrostatic pressure acting on the structure 604 from outside of the body 202'. A balanced distribution of hydrostatic pressure can prevent the hydrostatic force outside the body 202' from causing inadvertent movement of the structure 604. In some aspects, the structure 604 can be secured using shear pins 610 or another suitable retention mechanism to prevent inadvertent movement of the structure 604 in the absence of an actuation force.

The actuation structure 632 can be disposed proximate to the structure 604. The actuation structure 632 can be positioned to block a passage 626 into a chamber 634. The chamber 634 can be positioned adjacent to the piston 642. The actuation structure can be positioned to block an actuation inlet 630 disposed in the body 202'. The actuation structure 632 can include a passage 638. The passage 638 can provide a flow path through the actuation structure 632 into a piston chamber 646. The piston chamber can be positioned within the piston 642.

Figure 13B:
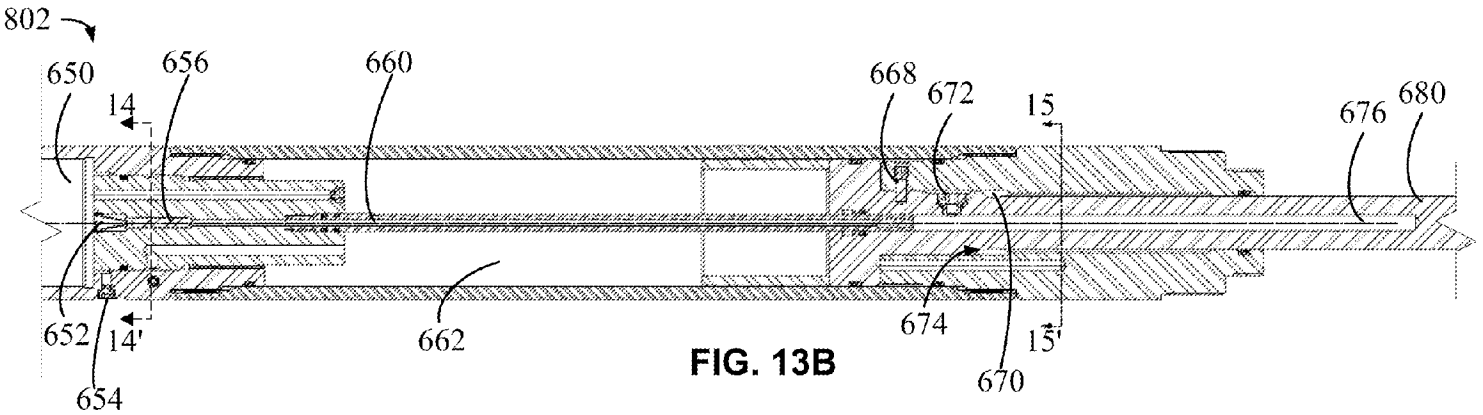
FIG. 13B is a longitudinal cross-sectional view of a second portion of the alternative exemplary downhole power delivery tool using hydrostatic pressure according to one aspect of the present disclosure.

FIG. 13B is a longitudinal cross-sectional view of a second portion 802 of the alternative exemplary downhole power delivery tool 116' using hydrostatic pressure. As depicted in FIG. 13B the downhole power delivery tool 116' can include a fill plug 654, a pressure chamber 670, a rupture disk 672, a filter 652, a metering mechanism 656, a rod conduit 660, and a rod reservoir 676.

The fill plug 654 may be removed to introduce the quantity of hydraulic fluid 650 into a downhole power delivery tool 116'. The fill plug 654 may be replaced to seal the hydraulic fluid 650 within the tool. In some aspects, the fill plug 654 depicted in FIG. 13B can be omitted.

The rod reservoir 676 can be disposed within the rod 680. The rod conduit 660 can provide a flow path for fluid communication of the hydraulic fluid 650 into the rod reservoir 676. The filter 652 can be disposed in the flow path of the hydraulic fluid 650 such that the fluid is communicated through the filter 652. A metering mechanism 656 can be disposed in the flow path of the hydraulic fluid 650.

The pressure chamber 670 can be positioned proximate to the rod 680. The rupture disk 672 can be positioned adjacent to the rod reservoir 676. The rupture disk 672 can be positioned so as to prevent communication of the hydraulic fluid 650 between the rod reservoir 676 and the pressure chamber 670.

Figure 14:
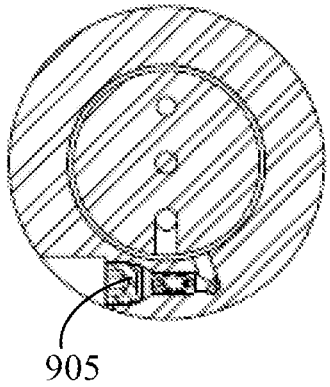
FIG. 14 is a lateral cross-sectional view of the alternative exemplary downhole power delivery tool using hydrostatic pressure according to one aspect of the present disclosure.

The rod chamber 662 can be configured as a vacuum chamber. FIG. 14 is a lateral cross-sectional view of the alternative exemplary downhole power delivery tool 116' using hydrostatic pressure. The view in FIG. 14 is taken along the line 14-14' depicted in FIG. 13B. As depicted in FIG. 14, the downhole power delivery tool 116' may include a vacuum test port 905. The vacuum test port 905 can be utilized to test the rod chamber 662 prior to deploying the downhole power delivery tool 116' in order to verify that the rod chamber 662 is maintaining a vacuum pressure.

Figure 15:
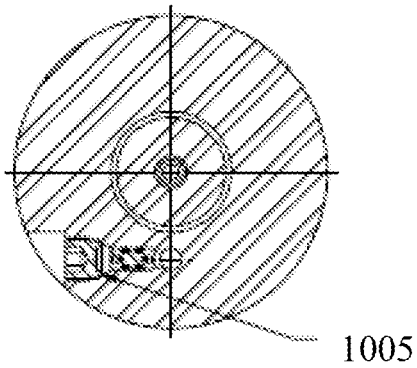
FIG. 15 is an additional lateral cross-sectional view of the alternative exemplary downhole power delivery tool using hydrostatic pressure according to one aspect of the present disclosure.

Additionally, the pressure chamber 670 can be configured as a vacuum chamber. FIG. 15 is an additional lateral cross-sectional view of the alternative exemplary downhole power delivery tool 116' using hydrostatic pressure. The view in FIG. 15 is taken along the line 15-15' depicted in FIG. 13B. As depicted in FIG. 15, the downhole power delivery tool 116' may include a vacuum test port 1005. The vacuum test port 1005 can be utilized to test the pressure chamber 670 prior to deploying the downhole power delivery tool 116' in order to verify that the pressure chamber 670 is maintaining a vacuum pressure.

Figure 16:
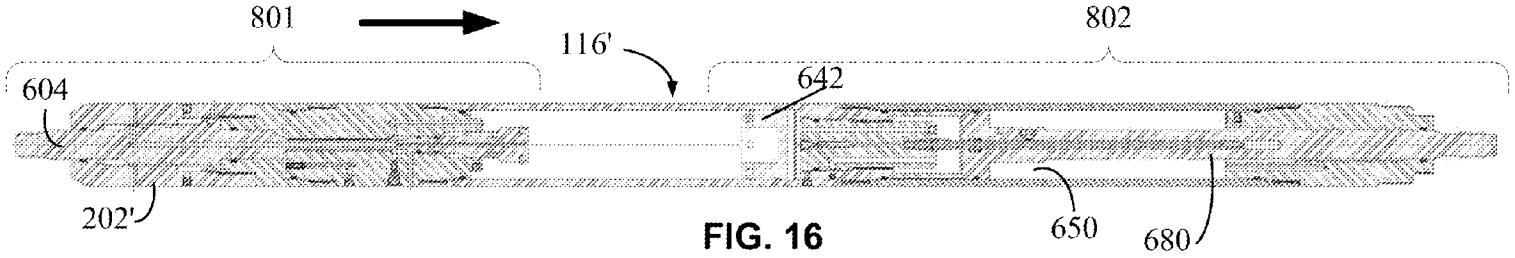
FIG. 16 is a longitudinal cross-sectional view of the alternative exemplary downhole power delivery tool actuated using hydrostatic pressure according to one aspect of the present disclosure.

FIG. 16 is a longitudinal cross-sectional view of the alternative exemplary downhole power delivery tool actuated using hydrostatic pressure. As depicted in FIG. 16, applying an actuation force can cause the piston 642 can move. Movement of the piston 642 can cause the rod 680 to retract into the rod chamber 662 in the body 202' of the downhole power delivery tool 116'.

Figure 17A:
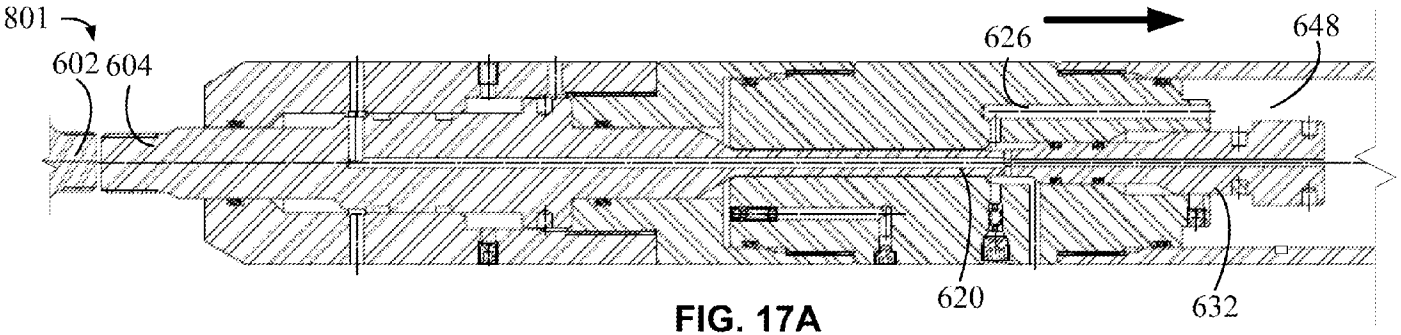
FIG. 17A is a longitudinal cross-sectional view of a first portion of the alternative exemplary downhole power delivery tool actuated using hydrostatic pressure according to one aspect of the present disclosure.

FIG. 17A is a longitudinal cross-sectional view of a first portion 801 of the alternative exemplary downhole power delivery tool 116' actuated using hydrostatic pressure.

The downhole power delivery tool 116' can be actuated by applying a force to the structure 604. Applying a force to the structure 604 can cause the structure 604 to move, as depicted by the rightward arrow in FIG. 17A. In one non-limiting example, applying an actuation force to the protruding portion of the structure 604 can include, jarring down on the protruding portion and contacting the structure 604 with a solid object 602. In another non-limiting example, a hydrostatic actuated electronic timing circuit utilizing a short stroke pusher can be used to displace the structure 604. In another non-limiting example, an electronic power delivery tool can be used to move the structure 604. Applying the actuation force on the structure 604 can cause the structure 604 to move in the direction in which the actuation force is applied. Applying the actuation force can also cause shear pins 610 to break and release the structure 604. Movement of the structure 604 can allow fluid to enter the downhole power delivery tool 116' as described further herein.

In one aspect, applying the actuation force can move the structure 604 into a position in which the port 606 is aligned with the inlet 608. Fluid can be communicated from outside of the body 202' via a flow path defined by the inlet 608, the port 606, and the conduit 624. The fluid communicated from outside of the body 202' can be annular fluid from the annulus between the body 202' and the formation 110. The annular fluid can have a hydrostatic pressure. The fluid from the annulus can be communicated to the actuation structure 632. The hydrostatic pressure of the fluid can exert sufficient force on the actuation structure 632 such that the actuation structure 632 can move. The force can also be sufficient to cause breakage of shear pins 640 utilized to prevent inadvertent movement of the actuation structure 632. Moving the actuation structure 632 can unblock the passage 626. Unblocking the passage 626 can communicate annular fluid to the chamber 634 (depicted in FIG. 13A). Communicating annular fluid to the chamber 634 can pressurize the chamber 634. Pressurizing the chamber 634 can exert a force on the piston 642 sufficient to make the piston 642 move. The force from pressurizing the chamber can also be sufficient to break the shear pins 640 and/or the shear pins 644 utilized to retain the piston 642 in place.

In additional or alternative aspects, applying the actuation force can move the structure 604 such that fluid flows through the inlet 608. Fluid flowing through the inlet 608 can move the actuation structure 632. Movement of the actuation structure 632 can unblock an actuation inlet 630 disposed in the body 202', thereby providing an alternate flow path for fluid from the outside of the body 202'. The alternate flow path provided by the actuation inlet 630 can provide an alternate or additional source of fluid for pressurizing the chamber 634 and moving the piston 642.

In additional alternative aspects, applying an actuation force can move the structure 604 such that fluid flows through the structure 604 to the actuation structure 632. The fluid can be communicated via a passage 638 through the actuation structure 632 and into the piston chamber 646 (depicted in FIG. 13A). The communicated fluid can pressurize the piston chamber 646 such that a pressure in the piston chamber 646 approaches the hydrostatic pressure. Pressurizing the piston chamber 646 can generate a force sufficient to cause the piston 642 to move away from the actuation structure 632.

In additional or alternative aspects, the applying an actuation force can move the structure 604 such that an inner end 620 of the structure 604 contacts the actuation structure 632. Contacting the actuation structure 632 can cause the actuation structure 632 to move. Movement of the actuation structure 632 can allow fluid to flow from either or both of the inlet 608 and the actuation inlet 630 into either or both of the chamber 634 or the piston chamber 646. The fluid flow can cause movement of the piston 642.

As depicted in FIG. 17A, the entry of annular fluid into the downhole power delivery tool 116' can exert sufficient pressure on the piston 642 to cause the piston 642 to move away from the actuation structure 632. Movement of the piston 642 away from the structure 604 can allow fluid communication between the chamber 634 and the piston chamber 646 (depicted in FIG. 13A). Fluid communication between the chamber 634 and the piston chamber 646 can allow the chamber 634 and the piston chamber 646 to effectively act as a combined chamber 648 (depicted in FIG. 17A).

Annular fluid can be communicated to the combined chamber 648 by any suitable path, as discussed above with respect to flow paths into chamber 634 and piston chamber 646. The annular fluid communicated to the combined chamber 648 can exert the sufficient pressure on a first side of the piston 642 to make the piston 642 move. The piston can communicate the pressure exerted on the first side of the piston 642 to the hydraulic fluid 650 positioned on the opposite side of the piston 642. Communication of pressure by the piston 642 can pressurize the hydraulic fluid 650 to approximately the same hydrostatic pressure of the fluid in the combined chamber 648.

Figure 17B:
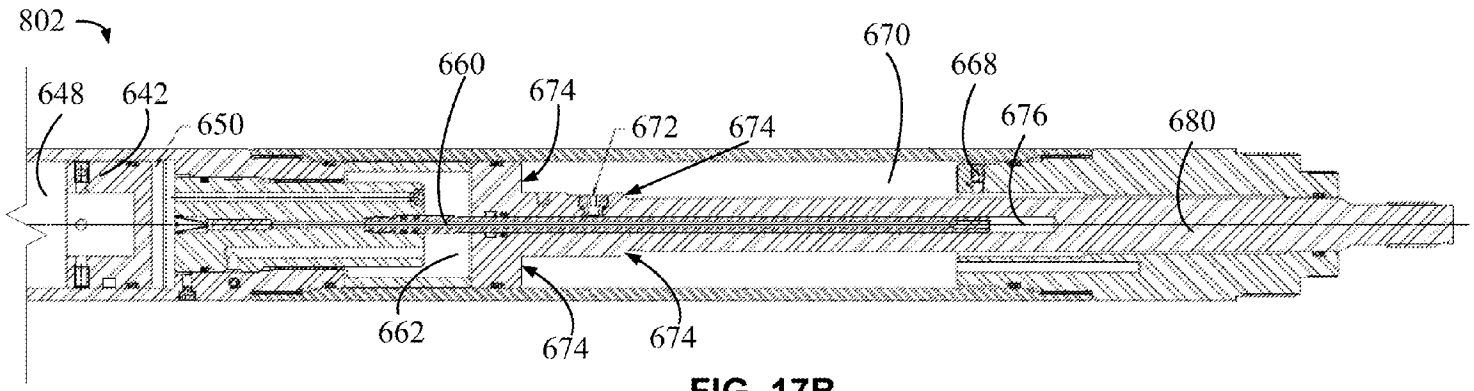
FIG. 17B is a longitudinal cross-sectional view of a second portion of the alternative exemplary downhole power delivery tool actuated using hydrostatic pressure according to one aspect of the present disclosure.

FIG. 17B is a longitudinal cross-sectional view of a second portion 802 of the alternative exemplary downhole power delivery tool 116' actuated using hydrostatic pressure. As depicted in FIG. 17B, the movement of the piston 642 can exert a force on a quantity of hydraulic fluid 650. Applying a force to the hydraulic fluid 650 can communicate the hydraulic fluid 650 through the rod conduit 660 into the rod reservoir 676. The hydraulic fluid 650 can pass through the metering mechanism 656 such that the hydraulic fluid 650 can be communicated at a controlled rate into the rod reservoir 676. Communication of the hydraulic fluid 650 to the rod reservoir 676 can pressurize the rod reservoir 676. For example, communication of the hydraulic fluid 650 to the rod reservoir 676 can pressurize the rod reservoir 676 such that the rod reservoir 676 may be pressurized to a hydrostatic pressure of the hydraulic fluid 650.

The rupture disk 672 can be ruptured by pressurization of the rod reservoir 676. Rupturing the rupture disk 672 can allow fluid communication of the hydraulic fluid 650 from the rod reservoir 676 into the pressure chamber 670. The hydraulic fluid 650 entering the pressure chamber 670 can exert a force upon a surface 674 of the rod 680. The force exerted on the surfaces 674 of the rod 680 can break shear pins 668 utilized to keep the rod in an extended state. The force exerted on the surface 674 of the rod 680 can also cause the rod to move and retract into a rod chamber 662 within the body 202' of the downhole power delivery tool 116'. Retraction of the rod 680 can be utilized to deliver power to another tool in the tubing string 112. In additional or alternative aspects, a downhole power delivery tool can include a number of modules. Modularity can facilitate ease of fabrication and can also provide flexibility to respond to a variety of operational circumstances. In one non-limiting example, the portion of the downhole power delivery tool 116 depicted in FIG. 5A can be combined with the portion of the downhole power delivery tool 116' depicted in FIG. 13B so as to provide a downhole power delivery tool operable in retraction and actuated utilizing a rupture disk and timer piston combination. In another non-limiting example, the portion of the downhole power delivery tool 116 depicted in FIG. 5B can be combined with the portion of the downhole power delivery tool 116' depicted in FIG. 13A so as to provide a downhole power delivery tool operable in extension and actuated by jarring.

In additional or alternative aspects, subassemblies of components of a downhole power delivery tool can be adapted so as to be interchangeable. For example, as depicted in FIGS. 10A and 13A, a rupture disk activation module 515 (depicted in a first style of crosshatch in FIG. 10A) may be removed from a hydraulic pressurization module 525 (depicted in a second style of crosshatch in FIG. 10A) and replaced with a jarring activation module 535 (depicted beginning with a third style of crosshatch and continuing leftward to the end of the downhole power delivery tool 116' in FIG. 13A). Rod assemblies may be also adapted as exchangeable modules to facilitate conversion of a downhole power delivery tool between operating in retraction and extension. For example, FIGS. 10B and 13B depict possible module boundaries using changes in crosshatch style.

In additional or alternative aspects, components may be removed or omitted from modules in order to change the actuation mode of the downhole power delivery tool. For example, the timer piston 320 and/or the metering mechanism 370 depicted in FIGS. 6 and 7A can be removed or omitted such that the downhole power delivery tool can be actuated without delay and/or at an uncontrolled rate upon the rupture of the rupture disk 314. Alternatively, the rupture disk 314 depicted in FIG. 5A can be removed or omitted such that hydrostatic pressure in the wellbore can be directly communicated to the timer piston 320 to initiate the timer delay.

The foregoing description, including illustrated aspects and examples, has been presented only for the purpose of illustration and description and is not intended to be exhaustive or to limiting to the precise forms disclosed. Numerous modifications, adaptations, and uses thereof will be apparent to those skilled in the art without departing from the scope of this disclosure.

What is claimed is:

1. A downhole power delivery tool positionable in a wellbore through a fluid-producing formation, the downhole power delivery tool comprising:

a body having a chamber disposed therein, the body defining an inlet proximate to the chamber;

an actuation mechanism disposed in the body and adjacent to the inlet, wherein the actuation mechanism allows communication of hydrostatic pressure via the inlet to the chamber from an annulus external to the body in response to an actuation force being applied to the actuation mechanism;

a piston proximate to the chamber, wherein the hydrostatic pressure communicated to the chamber in response to the actuation force being applied to the actuation mechanism applies a first force to the piston, wherein the piston applies a second force to a rod movable relative to the body in response to the first force being applied to the piston; and a hydraulic fluid proximate to the piston, wherein the hydraulic fluid applies the second force from the piston to the rod in response to the first force being communicated to the piston.

2. The downhole power delivery tool of claim 1, further comprising a metering mechanism proximate to the rod such that a flow of the hydraulic fluid is restricted by the metering mechanism, wherein the second force is applied to the rod over a period of time corresponding to a flow rate of the hydraulic fluid in response to the hydraulic fluid being restricted by the metering mechanism.

3. The downhole power delivery tool of claim 1, wherein the actuation mechanism comprises a barrier positioned adjacent to the inlet of the body, wherein the barrier is movable from a first position to a second position in response to the actuation force being applied to the barrier, wherein the barrier in the first position is positioned to prevent communication of fluid providing the hydrostatic pressure from the annulus to the chamber, wherein the barrier in the second position is positioned to allow communication of the hydrostatic pressure from the annulus to the chamber.

4. The downhole power delivery tool of claim 1, wherein the actuation mechanism comprises a rupture disk positioned adjacent to the inlet of the body such that communication of the hydrostatic pressure from the annulus to the chamber is prevented, wherein the rupture disk has a burst pressure corresponding to the actuation force being applied to the rupture disk.

5. The downhole power delivery tool of claim 4, wherein the actuation force comprises the hydrostatic pressure.

6. The downhole power delivery tool of claim 4, wherein the actuation mechanism further comprises a chemical charge, wherein the chemical charge generates the actuation force in response to receiving an electrical signal.

7. The downhole power delivery tool of claim 1, wherein the rod is movable from a first position in the body to a second position extending from the body in response to the second force.

8. The downhole power delivery tool of claim 1, wherein the rod is movable from a first position extended from the body to a second position retracted into the body in response to the second force.

9. A downhole power delivery tool positionable in a wellbore through a fluid-producing formation, the downhole power delivery tool comprising:

a body having a chamber disposed therein, the body defining an inlet proximate to the chamber;

an actuation mechanism disposed in the body and adjacent to the inlet, wherein the actuation mechanism allows communication of hydrostatic pressure via the inlet to the chamber from an annulus external to the body in response to an actuation force being applied to the actuation mechanism; and a piston proximate to the chamber, wherein the hydrostatic pressure communicated to the chamber in response to the actuation force being applied to the actuation mechanism applies a first force to the piston, wherein the piston applies a second force to a rod movable relative to the body in response to the first force being applied to the piston;

wherein the actuation mechanism comprises a barrier positioned adjacent to the inlet of the body, wherein the barrier is movable from a first position to a second position in response to the actuation force being applied to the barrier, wherein the barrier in the first position is positioned to prevent communication of fluid providing the hydrostatic pressure from the annulus to the chamber, wherein the barrier in the second position is positioned to allow communication of the hydrostatic pressure from the annulus to the chamber; and wherein the barrier comprises structure defining a port and a flow path from the port to the chamber, wherein the structure in the first position is positioned to prevent the communication of the hydrostatic pressure from the annulus to the chamber via the port and the flow path, wherein the structure in the second position is positioned such that the port is aligned with the inlet of the body, wherein the port being aligned with the inlet of the body allows the communication of the hydrostatic pressure from the annulus to the chamber via the port and the flow path.

10. A downhole power delivery tool positionable in a wellbore through a fluid-producing formation, the downhole power delivery tool comprising:

a body having a chamber disposed therein, the body defining an inlet proximate to the chamber;

an actuation mechanism disposed in the body and adjacent to the inlet, wherein the actuation mechanism allows communication of hydrostatic pressure via the inlet to the chamber from an annulus external to the body in response to an actuation force being applied to the actuation mechanism;

a piston proximate to the chamber, wherein the hydrostatic pressure communicated to the chamber in response to the actuation force being applied to the actuation mechanism applies a first force to the piston, wherein the piston applies a second force to a rod movable relative to the body in response to the first force being applied to the piston; and a hydraulic timer assembly comprising:

a timer piston;

a hydraulic fluid positioned adjacent to the timer piston; and a metering mechanism positioned proximate to the timer piston such that a flow of the hydraulic fluid is restricted by the metering mechanism;

wherein the timer piston is movable from a first position to a second position in response to the actuation force over a period of time corresponding to a flow rate of the flow of the hydraulic fluid as restricted by the metering mechanism and wherein the timer piston in the second position is positioned such that the actuation force is applied to the actuation mechanism by the timer piston.

11. A downhole power delivery tool positionable in a wellbore through a fluid-producing formation, the downhole power delivery tool comprising:

a body having a chamber disposed therein, the body defining a first inlet proximate to the chamber and defining a flow path into the chamber from an annulus between the body and the formation;

a rupture disk positioned adjacent to the first inlet of the body such that the flow path defined by the first inlet is blocked, the rupture disk having a burst pressure corresponding to an actuation force such that the actuation force being applied to the rupture disk allows communication of hydrostatic pressure from the annulus via the flow path into the chamber;

a piston proximate to the chamber, wherein the piston applies a force to a rod in response to the communication of the hydrostatic pressure from the annulus via the flow path to the chamber, the rod movable relative to the body; and a chemical charge proximate to the rupture disk, wherein the chemical charge generates the actuation force in response to receiving an electrical signal.

12. The downhole power delivery tool of claim 11, further comprising a hydraulic timer assembly, the hydraulic timer assembly comprising:

a timer piston disposed in the chamber;

a hydraulic fluid positioned adjacent to the timer piston; and a metering mechanism positioned proximate to the timer piston such that a flow of the hydraulic fluid is restricted by the metering mechanism;

wherein the timer piston is movable from a first position to a second position in response to the fluid communication into the chamber over a period of time corresponding to a flow rate of the flow of the hydraulic fluid as restricted by the metering mechanism and wherein the piston applies the force to the rod in response to a position of the timer piston in the second position.

13. The downhole power delivery tool of claim 11, further comprising:

an additional inlet proximate to an additional chamber disposed in the body and defining an additional flow path into the additional chamber from the annulus;

a barrier positioned adjacent to the additional inlet, the barrier movable from a first barrier position to a second barrier position in response to the fluid communication into the chamber, wherein the barrier in the first barrier position prevents the communication of the hydrostatic pressure from the annulus to the additional chamber via the additional inlet, wherein the barrier in the second barrier position allows the communication of the hydrostatic pressure from the annulus to the additional chamber via the additional inlet, and wherein the piston applies the force to the rod in response to the communication of the hydrostatic pressure from the annulus to the additional chamber via the additional inlet.

14. The downhole power delivery tool of claim 11, further comprising:

a hydraulic fluid proximate to the piston, wherein the hydraulic fluid applies the force from the piston to the rod in response to the fluid communication from the annulus into the first chamber; and a metering mechanism proximate to the rod such that a flow of the hydraulic fluid is restricted by the metering mechanism, wherein the force is applied to the rod over a period of time corresponding to a flow rate of the hydraulic fluid in response to the hydraulic fluid being restricted by the metering mechanism.

15. A downhole power delivery tool positionable in a wellbore through a fluid-producing formation, the downhole power delivery tool comprising:

a body having a chamber disposed therein;

an inlet through the body, the inlet proximate to the chamber;

a structure disposed in the body and positioned adjacent to the inlet, the structure defining a port and a conduit from the port to a first end of the chamber, wherein the structure is movable from a first position to a second position in response to an actuation force being applied to the structure, wherein the structure in the first position is positioned such that the port is blocked, wherein the structure in the second position is positioned such that the port is aligned with the inlet to communicate hydrostatic pressure to the chamber;

a piston adjacent to a second end of the chamber, wherein a force is applied to the piston in response to the hydrostatic pressure being communicated to the chamber, wherein the piston applies an additional force to a rod movable relative to the body in response to the force being applied to the piston;

an additional inlet through the body, the additional inlet proximate to a additional chamber disposed in the body; and a barrier positioned adjacent to the additional inlet, the barrier movable from a first barrier position to a second barrier position in response to the fluid communication into the chamber, wherein the barrier in the first barrier position prevents communication of the hydrostatic pressure to the additional chamber via the additional inlet, wherein the barrier in the second barrier position allows the communication of the hydrostatic pressure via the additional inlet, and wherein the piston applies the force to the rod in response to the communication of the hydrostatic pressure to the additional chamber via the additional inlet.

16. The downhole power delivery tool of claim 15, further comprising:

a hydraulic fluid disposed in the chamber, wherein the hydraulic fluid applies the force to the piston in response to the hydrostatic pressure being communicated to the hydraulic fluid disposed in the chamber; and a metering mechanism positioned proximate to the chamber, the metering mechanism comprising an additional structure defining a flow path, wherein an additional inlet of the additional structure is sized such that a flow of the hydraulic fluid is restricted by the metering mechanism, wherein the force is applied to the piston over a period of time corresponding to a flow rate of the flow of the hydraulic fluid in response to the flow of the hydraulic fluid being restricted by the metering mechanism.

17. The downhole power delivery tool of claim 15, further comprising a hydraulic timer assembly, the hydraulic timer assembly comprising:

a timer piston disposed in the chamber;

a hydraulic fluid positioned adjacent to the timer piston; and a metering mechanism positioned proximate to the timer piston such that a flow of the hydraulic fluid is restricted by the metering mechanism;

wherein the timer piston is movable from a third position to a fourth position in response to the communication of the hydrostatic pressure to the chamber over a period of time corresponding to a flow rate of the flow of the hydraulic fluid as restricted by the metering mechanism and wherein the force is applied to the piston in response to a position of the timer piston in the fourth position.

* * * * *